US007338426B2

(12) United States Patent
Samways

(10) Patent No.: US 7,338,426 B2
(45) Date of Patent: Mar. 4, 2008

(54) CENTRIFUGAL SEPARATOR WITH ROTATION DETECTOR

(75) Inventor: Andrew Samways, Dorchester (GB)

(73) Assignee: Mann & Hummel GmbH, Ludwigsburg (DE)

( * ) Notice: Subject to any disclaimer, the term of this patent is extended or adjusted under 35 U.S.C. 154(b) by 257 days.

(21) Appl. No.: 11/189,922

(22) Filed: Jul. 27, 2005

(65) Prior Publication Data

US 2006/0025296 A1 Feb. 2, 2006

(30) Foreign Application Priority Data

Jul. 30, 2004 (DE) ..... 10 2004 037 414

(51) Int. Cl.
*B04B 13/00* (2006.01)
*B04B 15/00* (2006.01)

(52) U.S. Cl. ..... 494/10

(58) Field of Classification Search ..... 494/10, 494/24, 36, 43, 49, 64, 65, 67, 83, 84, 901; 210/168, 171, 232, 360.1, 380.1, 416.5; 184/6.24
See application file for complete search history.

(56) References Cited

U.S. PATENT DOCUMENTS

| | | | | |
|---|---|---|---|---|
| 3,189,268 | A * | 6/1965 | Nilsson | 494/10 |
| 3,762,633 | A * | 10/1973 | Ishii | 494/10 |
| 3,986,663 | A * | 10/1976 | Jonsson et al. | 494/3 |
| 4,221,323 | A * | 9/1980 | Courtot | 494/10 |
| 4,900,453 | A * | 2/1990 | Sedlmayer | 210/742 |
| 6,058,899 | A * | 5/2000 | Schetter | 123/196 A |
| 6,213,928 | B1 * | 4/2001 | Joshi et al. | 494/10 |
| 6,572,523 | B2 * | 6/2003 | Herman et al. | 494/10 |
| 6,821,241 | B2 * | 11/2004 | Herman et al. | 494/5 |
| 2003/0078152 | A1 * | 4/2003 | Fischer et al. | 494/10 |
| 2006/0025296 | A1 * | 2/2006 | Samways | 494/10 |

FOREIGN PATENT DOCUMENTS

| | | |
|---|---|---|
| DE | 103 34 762 A1 | 2/2004 |
| SU | 986 506 A1 | 1/1983 |
| WO | WO 92/16303 A | 10/1992 |

OTHER PUBLICATIONS

Abstract for SU 986506 A, published Jan. 7, 1983.*
European Search Report dated Nov. 14, 2004 four (4) pages, with English translation of relevant portion.

* cited by examiner

*Primary Examiner*—Charles E. Cooley
(74) *Attorney, Agent, or Firm*—Crowell & Moring LLP

(57) ABSTRACT

A centrifugal separator for separating dirt particles from a fluid includes a separator cylinder, which rotates in a separator housing and into which the fluid to be cleaned is introduced. A detection device for indicating the operating state of the separator cylinder is provided, which includes a radially extending guide tube in which a detection element is accommodated in such a way that the detection element can be outwardly displaced within the guide tube under the influence of centrifugal force when the separator cylinder rotates and can move between a normal position and a contamination-indicating position.

16 Claims, 2 Drawing Sheets

CENTRIFUGAL SEPARATOR WITH ROTATION DETECTOR

BACKGROUND OF THE INVENTION

The invention relates to a centrifugal separator for separating dirt particles from a liquid comprising a rotating separator cylinder arranged in a separator housing.

U.S. Pat. No. 6,572,523 discloses a centrifugal separator that is used to clean motor oil in internal combustion engines. The centrifugal separator has a fixed housing in which a rotating separator cylinder is arranged that is supported and driven by a rotor shaft. The rotor shaft lies in a cylindrical tube whose wall is permeable and enclosed by a lamellar stack of plates, between which flow spaces are formed through which the solid component in the liquid is discharged outwardly under the action of the centrifugal forces. The liquid components, however, remain in the cylindrical tube and are discharged axially.

To make it possible to determine whether the separator cylinder is rotating at the desired speed within the fixed housing, the centrifugal separator has a detection device associated with it to indicate the rotational movement of the separator cylinder. This detection device comprises a rotor sensor with a visual display unit. The sensor comprises a coil fixed to the housing and a permanent magnet attached to the separator cylinder, which regularly passes the coil with each rotation of the separator cylinder, such that a voltage is induced in the coil that periodically causes the display unit to light up. If the display unit does not light up at all, or if the frequency is too low, a monitoring operator can see this from the outside without having to take the housing apart. This enables an early detection of any faults.

Possible faults include damaged bearings, for example. However, clogging of the filter unit by dirt deposits is almost impossible to detect, because the rotor speed is maintained even if the filter unit is clogged. As a result, there is a risk that the cleaning performance continues to decrease, without it being detected from the outside.

SUMMARY OF THE INVENTION

It is an object of the present invention to provide an improved centrifugal separator for separating dirt particles from a liquid.

A further object of the invention is to provide an improved centrifugal separator equipped with a device for detecting the rotational speed of the rotor.

Another object of the invention is to provide a centrifugal separator in which clogging or potentially clogging accumulations of dirt particles can be detected before cleaning performance significantly decreases.

These and other objects are achieved in accordance with the present invention by providing a centrifugal separator for separating dirt particles from a fluid, the separator comprising a rotatable separator cylinder which is arranged in a separator housing and into which the fluid to be cleaned is introduced, and a rotation detector which indicates rotational movement of the separator cylinder, wherein the detector comprises an at least approximately radially extending guide tube in which a detection element is accommodated such that the detection element can be outwardly displaced within the guide tube under the influence of centrifugal force as the separator cylinder rotates, the detection element being moveable between a normal position which the detection element assumes during normal operation of the centrifugal separator and a contamination position which the detection element assumes when an unacceptably high level of contamination exists in the centrifugal separator. Advantageous refinements and preferred embodiments are additionally described hereinafter.

The detection device, which is arranged in the centrifugal separator, includes at least one approximately radially extending guide tube in which a detection element is arranged so as to be moveable. As the centrifugal separator rotates, this detection element is moved radially outwardly under the influence of the centrifugal forces. In normal operation of the centrifugal separator, i.e., when no or no significant dirt deposits have accumulated yet, the detection element assumes a normal position, which is usually the radially outermost position within the guide tube. This outermost position cannot be reached, however, if too many dirt particles have collected within the rotating separator cylinder. In this case, the detection element can assume only a contamination-indicating position within the guide tube, but no longer its normal position. These different positions of the detection element can be indicated, so that it is possible to ascertain from the outside whether an unacceptably high degree of contamination is present in the separator cylinder. If this is the case, the centrifugal separator can be cleaned and serviced.

The principle underlying the invention is consequently based on the displacement of the detection element within the guide tube under the influence of the centrifugal force as the separator cylinder rotates. If there is an unacceptably high degree of contamination, the displacement of the detection element indicative of normal operation can no longer occur. This difference in the positions of the detection element in normal operation of the centrifugal separator on the one hand and with an unacceptably high degree of contamination on the other, can be detected and indicated.

The normal position of the detection element advantageously corresponds to a contact position in which the detection element is in contact with a signal unit. Thus, in the normal position, a contact is closed, such that a voltage can be induced in the signal unit, which is used, for example, to light up a visual display unit or is indicated in some other manner. The signal unit is preferably constructed as a co-rotating induction coil and further comprises a magnet that is fixed to the housing and a display device. In normal position, the detection element is in contact with the induction coil, such that the detection element is part of the closed coil circuit. To this end, the detection element is made of an electrically conductive material. As the separator cylinder rotates, the induction coil periodically passes the magnet fixed to the housing, thereby inducing a voltage that is used to light up the display unit.

In accordance with another preferred embodiment, two diametrically opposite guide tubes are provided within the separator cylinder, each with a detection element accommodated therein. The guide tubes have the same construction and each have an induction coil in addition to the displaceable detection element. The two induction coils of the guide tubes are interconnected by two open voltage wires, against which the respective detection element rests in normal position when the separator cylinder rotates, such that these ends of the voltage wires are electrically interconnected and a closed circuit is formed. The magnet, which is fixed to the housing, and the display unit, likewise fixed to the housing, are arranged diametrically opposite each other, such that one coil, including the detection element, passes the permanent magnet directly in one position during rotation, and at the same time, in the opposite guide tube, the second detection element, including the corresponding induction coil, passes the display unit. The permanent magnet induces a voltage in the passing induction coil, which is transmitted via the voltage wires to the opposite coil. The coil lying opposite the magnet can induce a voltage pulse in a coil of the display unit, which causes a visual display unit to light up. With a further rotation by 180°, the next induction coil passes the permanent magnet, such that the entire process is repeated. The visual display unit therefore flickers at twice the frequency compared to the rotating separator cylinder.

The radially outer ends of the guide tubes are open, such that dirt accumulating along the interior wall of the separator cylinder can get into the guide tubes through the open ends, preventing the detection element from reaching the normal position in which the contact between the voltage wires is closed. In this case, the detection element can no longer reach its normal position and no contact is established. The display unit remains extinguished, which can be registered by the monitoring operator. This hindered position of the detection element can be referred to as the contamination position.

Advantageously, the density of the detection element is selected to be greater than the density of the fluid flowing through the centrifugal separator. At the same time, the density of the detection element is less than the average density of the dirt particles that are carried along in the fluid and are to be separated therefrom. This density distribution assures that the detection element can on the one hand move within the guide tube against the resistance of the fluid. On the other hand, as the dirt deposits along the interior wall of the separator cylinder increase, the dirt pushes the detection element out of the contact or normal position.

Other advantages and useful embodiments of the invention are described in the following.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
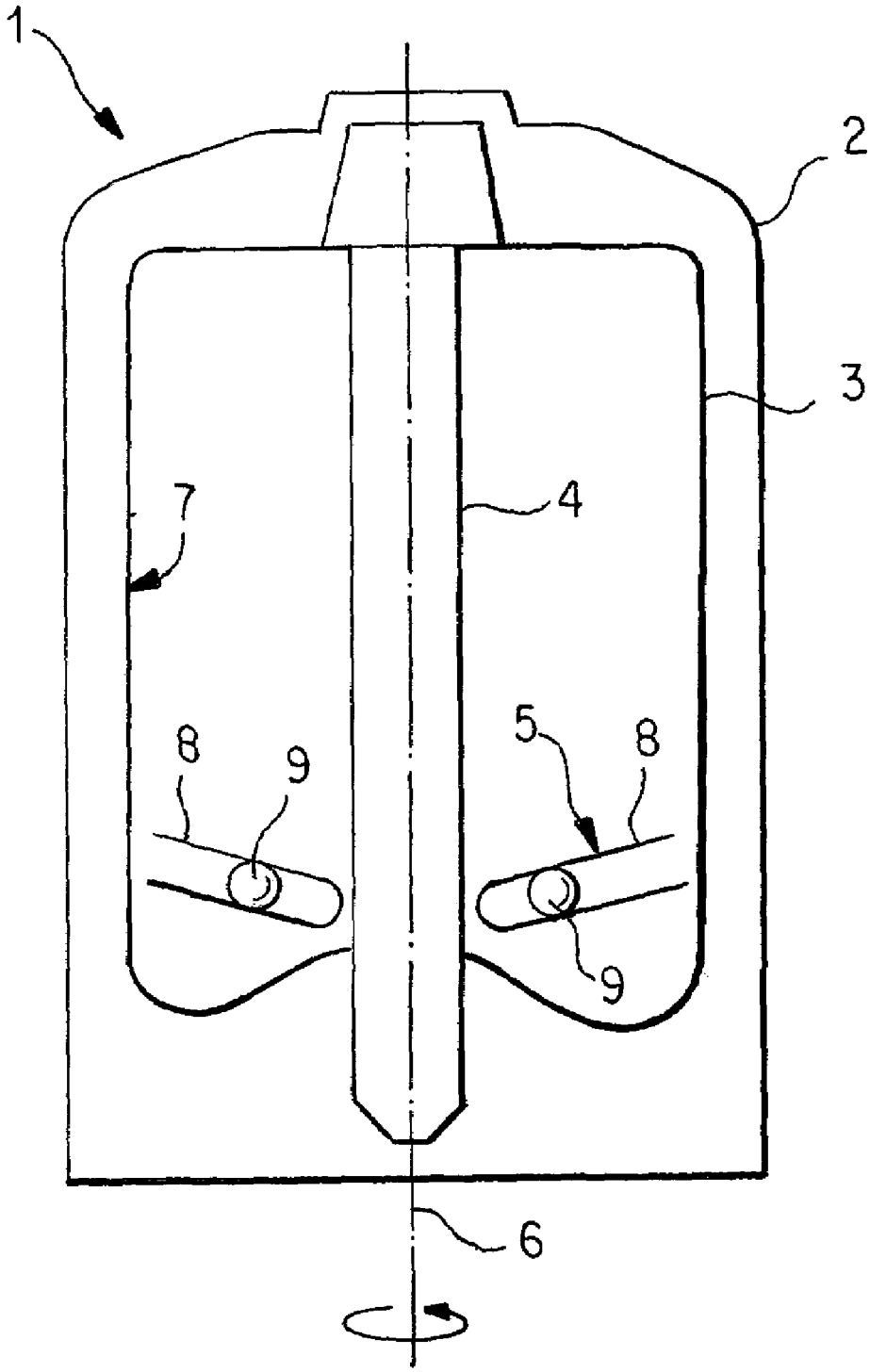
FIG. 1 is a schematic representation of a centrifugal separator with a detection device disposed in a bottom area, which is used to determine the degree of contamination in the centrifugal separator.

In the following description, like components in the figures are identified by the same reference numerals.

FIG. 1 depicts a centrifugal separator 1 designed to separate dirt particles in a fluid, particularly in a liquid, for example oil, and includes a fixed separator housing 2 in which a separator cylinder 3 is supported for rotation about the rotational axis 6. To realize the rotational movement, a shaft 4 coaxial to the rotational axis 6 is supported for rotation in the separator cylinder 3 relative to the separator housing 2 and is driven by a drive motor.

The fluid to be cleaned is introduced into the interior of the separator cylinder 3, such that the dirt particles in the fluid, which normally have a greater density than the fluid, are flung radially outwardly under the action of the centrifugal force due to the rotational movement and are deposited along the interior wall 7 of the separator cylinder 3. The clean fluid, from which the dirt particles have been removed, can then be discharged from the separator housing 2.

In the bottom area of the separator cylinder 3, a detection device 5 is arranged to determine the degree of contamination, particularly the thickness of the layer of dirt deposited along the interior wall 7. The detection device 5 will now be described with reference to the following figures.

The detection device 5 comprises two diametrically opposite, radially extending fluid tubes or guide tubes 8 in which detection balls 9 are supported, which act as detection elements and are capable of rolling along the inside of the guide tubes 8. The detection balls 9 are made of an electrically conductive material. As an additional condition, the detection balls further satisfy the requirement that their density be less than the density of the dirt particles to be deposited but greater than the density of the fluid.

The two guide tubes 8 ascend radially from the inside toward the outside and form an approximately 20° angle relative to a plane perpendicular to the rotational axis 6. Because of this inclined angle, the detection balls roll inwardly toward the shaft 4 when the centrifugal separator is stopped. This position of the detection balls 9 represents the initial position.

Figure 2:
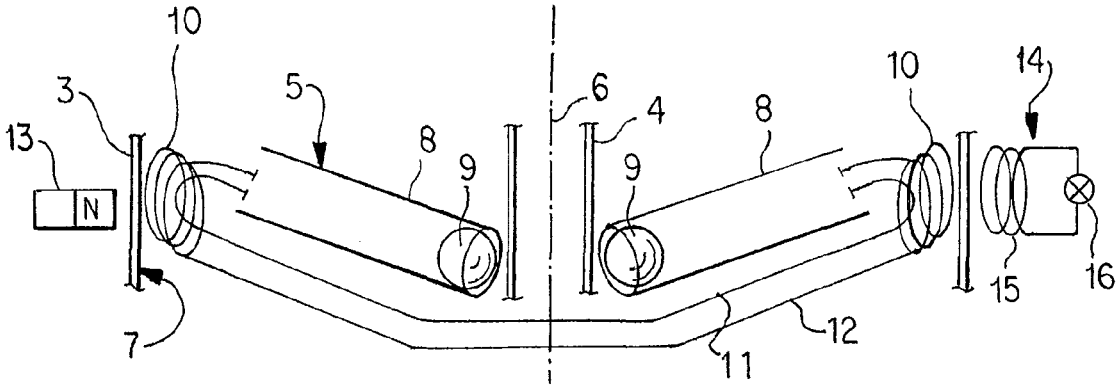
FIG. 2 is an enlarged representation of the detection device in the initial state with the centrifugal separator standing still.

As can be seen in FIG. 2, each guide tube 8 of the detection device is associated with an induction coil 10. These induction coils are arranged directly on the interior wall 7 of the separator cylinder 3, adjacent the open, radially outlying face of each guide tube 8. The coils 10, like the guide tubes 8, execute the same rotational movement as the separator cylinder 3. The induction coils 10 are interconnected by two voltage wires 11 and 12, which are likewise arranged within the separator cylinder 3. The free ends of the two voltage wires 11 and 12 each extend into the open, radially outlying face of each guide tube 8.

The detection device 5 is further associated with a permanent magnet 13, which is disposed outside the separator cylinder 3 and is fixed to the separator housing. Diametrically opposite the permanent magnet 13, a display device 14 is provided, which is likewise fixed to the housing and comprises a further induction coil 15 and a display unit 16 connected to the induction coil 15, such as a light emitting diode, for example. As the separator cylinder 3 rotates about its rotational axis 6, each induction coil 10 passes, respectively, the permanent magnet 13 and the display unit 14 at an angular distance of 180°.

Figure 3:
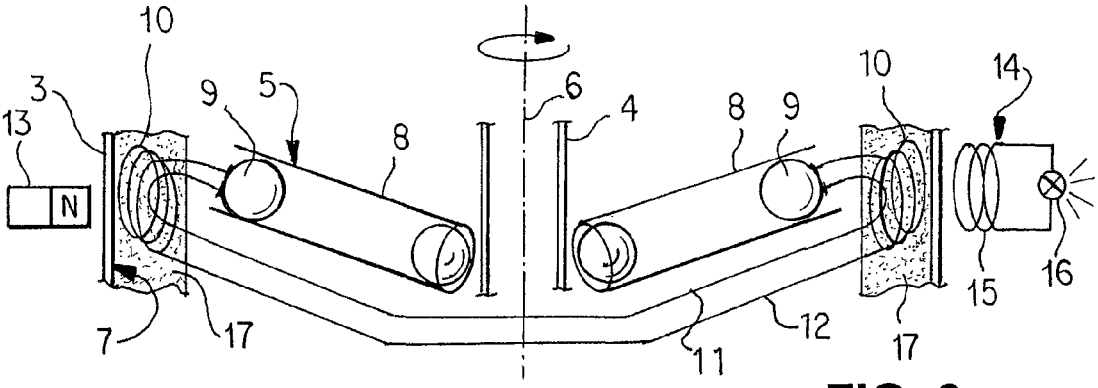
FIG. 3 is a representation corresponding to FIG. 2, but with the detection element of the detection device in its radially outwardly displaced normal position.
Figure 4:
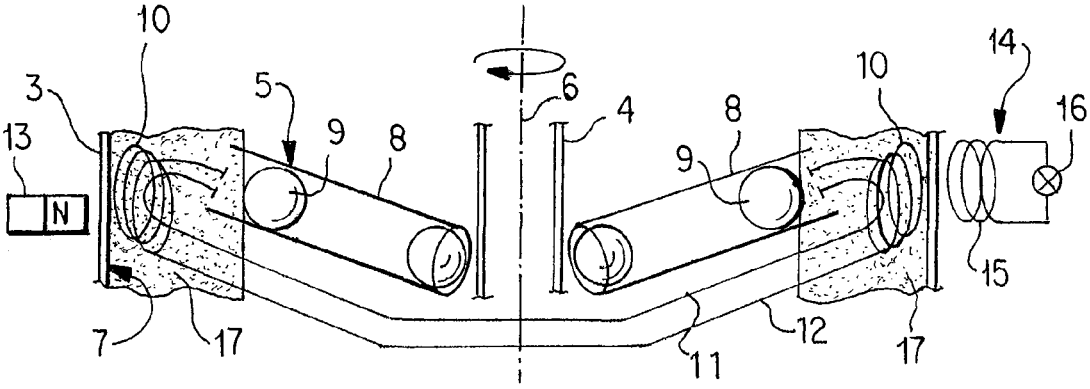
FIG. 4 is a representation corresponding to FIG. 2 and FIG. 3, but with dirt deposits along the interior wall of the separator cylinder, which prevent the detection element from assuming its normal position.

FIGS. 3 and 4 show the centrifugal separator in its operating state, in which the separator cylinder 3 rotates about the rotational axis 6. In FIG. 3, the detection balls 9 have moved radially outwardly within the guide tubes 8 under the influence of the centrifugal forces, overcoming the slope at which the guide tubes are arranged in the separator cylinder 3. In normal operation, which is illustrated in FIG. 3, the detection balls 9 move radially outwardly until the balls 9 contact the free ends of the voltage wires 11 and 12. In this position an electrically closed circuit is formed with the two induction coils 10 and the two voltage wires 11 and 12.

When the permanent magnet 13 is passed, a voltage is induced in the currently adjacent induction coil 10, which is transmitted through the two voltage wires 11 and 12 to the diametrically opposite induction coil 10, which at that moment passes the display device 14 with the induction coil 15. This induces a voltage pulse in the induction coil 15, which causes the display unit 16 of the display device 14 to light up.

As can be seen in FIG. 3, a layer of dirt deposits 17 has already accumulated along the interior wall 7 of the separator cylinder 3. The dirt layer is still relatively thin, however, and has no adverse effect on the functional performance of the centrifugal separator. The layer of dirt deposits 17 does not yet extend into the free face of the guide tubes 8.

This condition is reached in FIG. 4, however. The layer of dirt deposits 17 has grown thick enough that it extends all the way into the open ends of the guide tubes 8, and due to its greater density pushes the detection balls 9 back and prevents the detection balls 9 from contacting the free ends of the voltage wires 11 and 12 (contamination position).

As a result, the circuit between the diametrically opposite coils 10 is interrupted, such that the voltage induced when the permanent magnet 13 is passed is no longer transmitted to the opposite coil 10, and no voltage pulse is therefore generated in the display device 14. The display unit 16 can thus no longer light up. The failure of the display to light up can be determined by an operator, who can then take measures to clean and service the centrifugal separator.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A centrifugal separator for separating dirt particles from a fluid, said separator comprising a rotatable separator cylinder which is arranged in a separator housing and into which the fluid to be cleaned is introduced, and a rotation detector which indicates rotational movement of the separator cylinder, wherein said detector comprises an at least approximately radially extending guide tube in which a detection element is accommodated such that the detection element can be outwardly displaced within the guide tube under the influence of centrifugal force as the separator cylinder rotates, said detection element being moveable between a normal position which the detection element assumes during normal operation of the centrifugal separator and a contamination position which the detection element assumes when an unacceptably high level of contamination exists in the centrifugal separator; wherein the guide tube forms an angle with a plane perpendicular to the rotational axis of the separator cylinder, and wherein the guide tube slopes downwardly toward the rotational axis of the separator cylinder.

2. A centrifugal separator according to claim 1, wherein said normal position of the detection element is the radially outermost position within the radially extending guide tube.

3. A centrifugal separator according to claim 2, wherein the radially outlying face of the guide tube is open.

4. A centrifugal separator according to claim 1, wherein the detection element has a density which is greater than that of the fluid to be cleaned but less than the average density of the dirt particles in the fluid.

5. A centrifugal separator according to claim 1, wherein the detection element is constructed as a detector ball.

6. A centrifugal separator for separating dirt particles from a fluid, said separator comprising a rotatable separator cylinder which is arranged in a separator housing and into which the fluid to be cleaned is introduced, and a rotation detector which indicates rotational movement of the separator cylinder, wherein said detector comprises an at least approximately radially extending guide tube in which a detection element is accommodated such that the detection element can be outwardly displaced within the guide tube under the influence of centrifugal force as the separator cylinder rotates, said detection element being moveable between a normal position which the detection element assumes during normal operation of the centrifugal separator and a contamination position which the detection element assumes when an unacceptably high level of contamination exists in the centrifugal separator; wherein the normal position of the detection element is a contact position in which the detection element contacts a signal unit, and wherein the signal unit comprises a co-rotating induction coil, a magnet fixed to the housing, and a display device, such that in the normal position, the detection element forms an electrical contact with the induction coil, and the induction coil passes the magnet during each rotation of the separator cylinder.

7. A centrifugal separator according to claim 6, wherein the display device comprises a further induction coil with a visual display unit.

8. A centrifugal separator according to claim 6, wherein said normal position of the detection element is the radially outermost position within the radially extending guide tube.

9. A centrifugal separator according to claim 8, wherein the radially outlying face of the guide tube is open.

10. A centrifugal separator according to claim 6, wherein the detection element has a density which is greater than that of the fluid to be cleaned but less than the average density of the dirt particles in the fluid.

11. A centrifugal separator according to claim 6, wherein the detection element is constructed as a detector ball.

12. A centrifugal separator for separating dirt particles from a fluid, said separator comprising a rotatable separator cylinder which is arranged in a separator housing and into which the fluid to be cleaned is introduced, and a rotation detector which indicates rotational movement of the separator cylinder, wherein said detector comprises an at least approximately radially extending guide tube in which a detection element is accommodated such that the detection element can be outwardly displaced within the guide tube under the influence of centrifugal force as the separator cylinder rotates, said detection element being moveable between a normal position which the detection element assumes during normal operation of the centrifugal separator and a contamination position which the detection element assumes when an unacceptably high level of contamination exists in the centrifugal separator; wherein two guide tubes are provided, each having a detection element accommodated therein, and wherein each guide tube is associated with a respective induction coil, and the two induction coils are interconnected by two open voltage wires, which are electrically closed when the two detection elements are both in their normal positions.

13. A centrifugal separator according to claim 12, wherein said normal position of the detection element is the radially outermost position within the radially extending guide tube.

14. A centrifugal separator according to claim 13, wherein the radially outlying face of the guide tube is open.

15. A centrifugal separator according to claim 12, wherein the detection element has a density which is greater than that of the fluid to be cleaned but less than the average density of the dirt particles in the fluid.

16. A centrifugal separator according to claim 12, wherein the detection element is constructed as a detector ball.

* * * * *